US005778700A

United States Patent [19]

Lee et al.

[11] Patent Number: 5,778,700

[45] Date of Patent: Jul. 14, 1998

[54] METHOD OF PRODUCING GASEOUS OXYGEN AT VARIABLE RATE

[75] Inventors: Rong-Jwyn Lee, Sugarland, Tex.; Joseph P. Naumovitz, Lebanon; Craig Steven LaForce, Whitehouse Station, both of N.J.

[73] Assignee: The BOC Group, Inc., New Providence, N.J.

[21] Appl. No.: 846,748

[22] Filed: Apr. 30, 1997

[51] Int. Cl.[6] ..... F25J 3/00

[52] U.S. Cl. ..... 62/656; 364/501

[58] Field of Search ..... 62/656; 364/501

[56] References Cited

U.S. PATENT DOCUMENTS 5,084,081 1/1992 Rohde ..... 62/656

5,355,680 10/1994 Darredeau et al. ..... 62/656

5,406,800 4/1995 Bonaquist ..... 62/656

5,431,023 7/1995 Howard et al. ..... 62/656

*Primary Examiner*—Ronald C. Capossela

*Attorney, Agent, or Firm*—David M. Rosenblum; Salvatore P. Pace

[57] ABSTRACT

A method of producing gaseous oxygen in accordance with a variable demand cycle in which pumped liquid oxygen from a double column air separation unit is vaporized within a mixing column. During low demand phases, excess liquid oxygen is stored within a storage tank and used to augment the liquid oxygen to vaporized during the high demand phase. Reflux to the lower pressure column of the air separation unit is kept constant by storing liquid with column bottoms produced within the mixing column during the high demand phase for use in the low demand phase when less liquid oxygen is vaporized and therefore less column bottoms is produced in the mixing column.

6 Claims, 1 Drawing Sheet

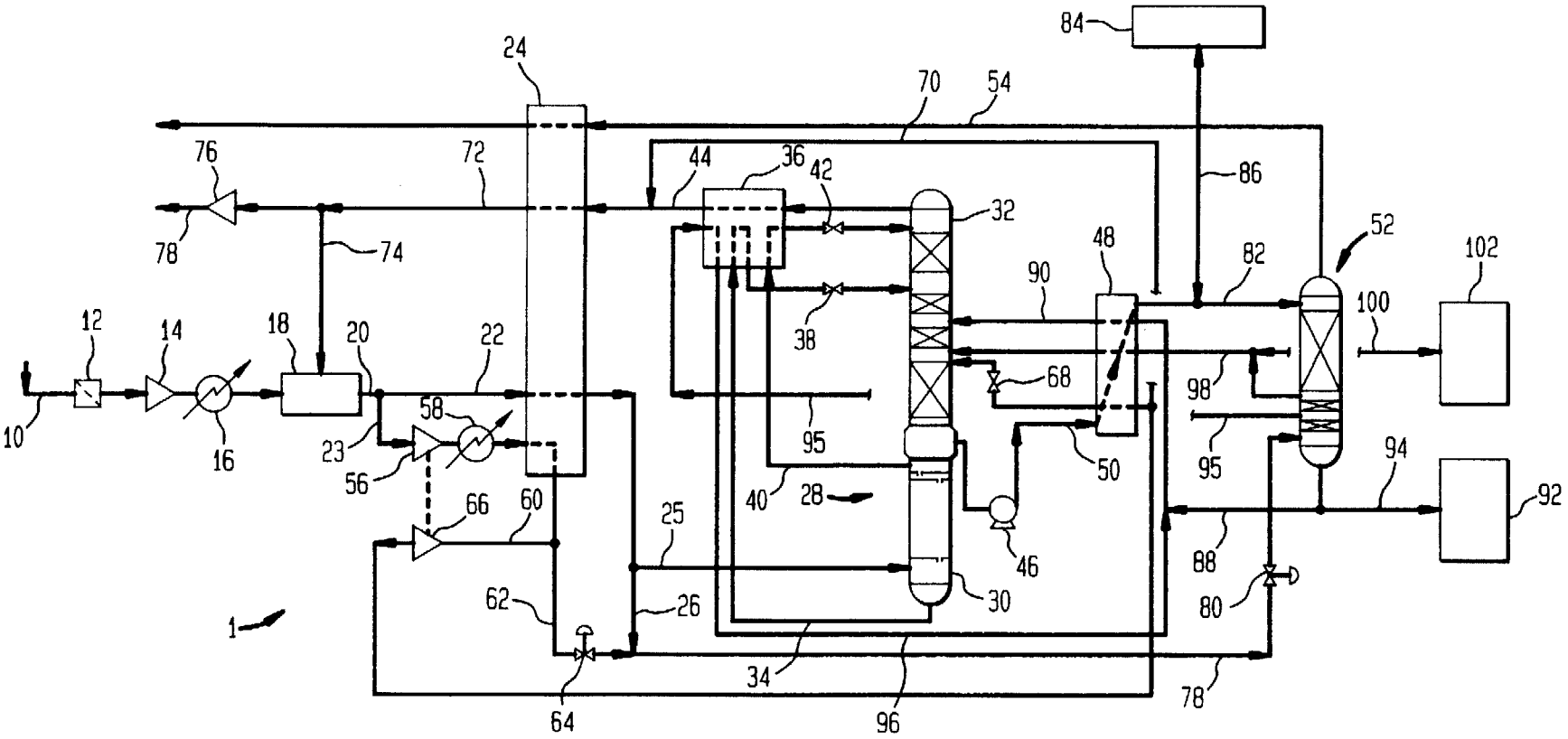
FIG.

METHOD OF PRODUCING GASEOUS OXYGEN AT VARIABLE RATE

BACKGROUND OF THE INVENTION

The present invention relates to a method of rectifying air to produce a pressurized oxygen product. More particularly, the present invention relates to such a method in which liquid oxygen produced in a lower pressure column of a double column unit is pumped to a delivery pressure and then is vaporized within a mixing column. Even more particularly, the present invention relates to such a method in which oxygen production during high demand phases is augmented with excess liquid oxygen previously stored during low demand phases and column conditions are stabilized by augmenting reflux to the lower pressure column during low demand phases with excess reflux stored during high demand phases.

A variety of industrial processes have time varying oxygen requirements which are met by cryogenic air separation plants adapted to vary the production rate of oxygen. In such air separation plants, liquid oxygen is stored during a low demand phase and liquid nitrogen is stored during a high demand phase. The liquid nitrogen and gaseous oxygen products are produced by vaporizing the stored liquid oxygen against condensing gaseous nitrogen produced by the plant.

In one type of plant, gaseous product oxygen is supplied from the low pressure column. Such a plant is described in the "Linde Reports on Science and Technology", Number 37, 1984. In the plant, oxygen vaporizes against the condensation of nitrogen produced at the top of the higher pressure column. The amount of high pressure nitrogen extracted to balance plant refrigeration is controlled to adjust the amount of gaseous oxygen supplied, either above or below a nominal rate. During a high demand phase, the amount of high pressure nitrogen extracted from the higher pressure column is reduced below that which is required to be extracted to produce gaseous oxygen at the nominal production rate. As result, there is an increase in the degree to which liquid oxygen in the bottom of the low pressure evaporates and high pressure nitrogen at the top of the high pressure column condenses. This produces an increase in the amount of liquid nitrogen collected at the top of the higher pressure column which is extracted and stored in a storage tank. Liquid oxygen stored in another storage tank during the low demand phase, is supplied to the low pressure column to replenish oxygen in the bottom of the low pressure column. During the low demand phase the amount of high pressure nitrogen extracted from the high pressure column is increased over that required to be extracted for the production of oxygen at the nominal rate. This increases the amount of liquid oxygen collected at the bottom of the low pressure column because there is less high pressure nitrogen at the top of the high pressure column to condense. The increased amount of liquid oxygen collected in the low pressure column is extracted and stored for future use, during the high demand phase.

A major problem in the type of plant, discussed above, is that optimization of the hydraulic design of the column and oxygen recovery over the full extent of the demand is highly problematical. A major operational problem is that it is difficult to control the purity of the oxygen being recovered because the reflux rate to the column changes over the course of the demand pattern changes. Also, the oxygen that is recovered can only be recovered at low pressure column pressure and therefore, the oxygen would need to be compressed for use at higher pressures.

As will be discussed, the present invention provides an oxygen production method in which reflux rates in the lower pressure column are stable to allow optimization of the hydraulic design of such a column and supply of the oxygen at a constant purity.

SUMMARY OF THE INVENTION

A method of producing gaseous oxygen at a variable rate is provided having cyclically repeating high and low demand phases. In accordance with the method, air is rectified in a cryogenic rectification process including a double distillation column having higher and lower pressure distillation columns. The higher and lower pressure distillation columns are operatively associated with one another in a heat transfer relationship to produce a liquid oxygen column bottoms in the lower pressure column. A pressurized liquid oxygen stream is introduced into a mixing column to produce the gaseous oxygen as a tower overhead and an oxygen enriched column bottoms. A reflux stream is introduced into the lower pressure column as reflux and a liquid oxygen column bottoms is removed from the lower pressure column.

During the low demand phase, part of the liquid oxygen column bottoms is used to form the pressurized liquid oxygen stream. A remaining part of the liquid oxygen column bottoms is stored at this time to create stored liquid oxygen column bottoms. During the high demand phase, all the liquid oxygen column bottoms removed from the lower pressure column and the stored liquid oxygen column bottoms are used to form the pressurized liquid oxygen stream. Oxygen enriched liquid column bottoms is removed from the mixing column. During the high demand phase, part of the oxygen enriched liquid column bottoms is removed from the mixing column to form the reflux stream and a remaining part of the oxygen enriched liquid column bottoms is stored to create stored oxygen enriched liquid column bottoms. During the low demand phase, all the oxygen enriched liquid column bottoms is removed from the mixing column and stored oxygen enriched liquid column bottoms to form the reflux stream.

The removal of the liquid oxygen column bottoms from the lower pressure column and the removal of all of the oxygen enriched column bottoms from the mixing column are conducted so that the flow rates of the liquid oxygen column bottoms removed from the lower pressure column and the reflux stream remain substantially constant during both the high and low demand phases. A product stream is extracted which is composed of tower overhead of the mixing column.

Since the reflux rate remains constant and the rate at which liquid oxygen column bottoms is removed from the low pressure column also remains constant, liquid oxygen is produced at a constant purity. Since it is liquid that is being produced, it can advantageously be pumped from low pressure column pressure up to a higher operating pressure and then vaporized within the mixing column.

BRIEF DESCRIPTION OF THE DRAWINGS

While the specification concludes with claims distinctly pointing out the subject matter that Applicants regard as their invention, it is believed the invention will be better understood when taken in connection with the accompanying drawing in which the sole figure is a schematic of an apparatus for carrying out a method in accordance with the present invention.

DETAILED DESCRIPTION

With reference to the FIGURE, an air separation plant 1 is illustrated for carrying out the method of the present invention. In accordance with the method, an air stream 10 is filtered in a filter 12 and is thereafter compressed in a main compressor 14. After heat of compression is removed by an aftercooler 16, the air is purified of heavy contaminants (such as moisture, carbon dioxide and hydrocarbons) within a prepurification unit 18. A now compressed and purified air stream 20 is divided into first and second subsidiary air streams 22 and 23.

First subsidiary air stream 22, after having been fully cooled (that is cooled to a temperature suitable for its rectification) within main heat exchanger 24 is divided into first and second portions 25 and 26. First portion 25 is introduced into an air separation unit 28 having a higher pressure column 30 and a lower pressure column 32. Air separation unit 28 is a known double distillation column in which the higher and lower pressure columns 30 and 32 are operatively associated with one another in a heat transfer relationship. Air introduced into higher pressure column 30 is rectified to produce an oxygen enriched liquid column bottoms which further refined in lower pressure column 32 to produce a liquid oxygen column bottoms in lower pressure column 32.

The column bottoms of higher pressure column 30 is removed as an oxygen enriched stream 34. After subcooling within a subcooling unit 36, oxygen enriched stream 34 is pressure reduced by a pressure reduction valve 38 and then introduced into lower pressure column 32 for further refinement. The tower overhead of higher pressure column 30 is removed as a nitrogen rich stream 40, which, after subcooling in subcooling unit 36 and pressure reduction by a pressure reduction valve 42, is introduced into the top of lower pressure column 32 for reflux purposes. Gaseous nitrogen is removed as a waste stream 44. Waste stream 44 warms within subcooling unit 36 in order to perform subcooling heat transfer duty.

Liquid oxygen column bottoms is pumped in a pump 46. As will be discussed, the resultant pumped stream 50 after warming in a subcooling unit 48 is used to form a pressurized oxygen stream which is vaporized within a mixing column 52. In mixing column 52, a gaseous oxygen product stream 54, formed of tower overhead, is extracted and warmed to ambient within main heat exchanger 24.

Second subsidiary air stream 23 is compressed within a booster compressor 56. After removal of the heat of compression by an aftercooler 58, second subsidiary air stream is cooled to an intermediate temperature between the temperature of the distillation of air separation unit 28 and ambient. After such partial cooling, second subsidiary air stream 23 can be divided into first and second parts 60 and 62. As will be discussed, a cut-off valve 64 is used to cut-off the flow of second part 62 of second subsidiary air stream 23 so that no such division takes place.

First part 60 is expanded within a turboexpander 66. First part 60 can as illustrated be divided so that a portion of first part 60 subcooled within subcooling heat exchanger 48, then is pressure reduced within a pressure reduction valve 68, and introduced into lower pressure column 32. A remaining portion 70 of first part 60 is combined with nitrogen rich stream 44 and then fully warmed within main heat exchanger 24. This combined stream 72 is subdivided into a regenerating stream 74 which is used in regenerating prepurification unit 18. Blower 76 can be provided to pressurize the resultant gaseous nitrogen product stream 78 to working pressure in the event that first part 60 is expanded to below atmospheric pressure. In such illustrated embodiment, the portion of first part 60 that is introduced into lower pressure column 32 acts as a Lachmann air stream while remaining portion 70 acts to decrease the enthalpy of the incoming air. Thus, in such embodiment there are two refrigerant air streams. As can be appreciated, the present invention covers an embodiment in which either all of first part 60 is introduced into lower pressure column 32 or is combined with nitrogen rich stream 44.

During a high demand phase, the output of main compressor 14 is turned up and cut-off valve 64 is opened so that second part 62 of second subsidiary air stream 23 is produced and combines with second portion 26 of first subsidiary air stream 22. The resultant combined stream 78 is fed into a bottom region of mixing column 52 in order to vaporize pressurized descending liquid.

During the low demand phase, when less oxygen is required, the output of main compressor 14 is turned down and cut-off valve 64 is activated to cut-off flow of second part 62 of second subsidiary air stream 23. As such, all of second subsidiary air stream 23 is expanded within turboexpander 66. It is a principal object of the present invention to operate lower pressure column 32 under conditions of constant reflux. Hence, the flow rate of first part 60 of second subsidiary air stream 23 must be held constant. However, during the low demand phase, less pressurized liquid oxygen need be vaporized within mixing column 52 and therefore, the flow rate of combined stream 78 is decreased by the amount that main compressor 14 is turned down. In order to maintain first part 60 of second subsidiary air stream 23 and first portion 25 of first subsidiary air stream 22 at the same flow rates as were obtained during the high demand phase, cut-off valve 64 is set in the off position and a proportional valve 80 is turned down.

A pressurized liquid oxygen stream 82 is introduced into a top region of mixing column 52 to produce the gaseous oxygen as tower overhead which will be withdrawn as product stream 54. During the high demand phase, pressurized liquid oxygen stream 82 is augmented with liquid oxygen column bottoms which has been produced during the low demand phase and stored within a pressurized storage tank 84. The stored liquid oxygen column bottoms is added to pumped liquid stream 50 as a reversible stream 86. The term "reversible stream" means that the stream can flow within a pipe in either direction. During the low demand phase, the flow rate of pressurized liquid oxygen stream 82 to be vaporized must decrease due to the lower demand. To this end, part of the pumped liquid stream 50 is stored within storage tank 84 to produce stored liquid oxygen column bottoms.

Reflux to lower pressure column 32 is also supplied from oxygen enriched column bottoms of mixing column 52. An oxygen enriched column bottoms stream 88 in part forms a reflux stream 90. Reflux stream 90, after being subcooled within subcooling heat exchanger 48, is added into low pressure column 32 as reflux. During the high demand phase, only part of the oxygen enriched liquid column bottoms is removed from the mixing column to form reflux stream 90. A remaining part of the oxygen enriched liquid column bottoms is stored within a storage tank 92 through addition of a reversible stream 94. During the low demand phase, all of the oxygen enriched liquid column bottoms produced in mixing column 52 is used and is augmented with stored oxygen enriched column bottoms from storage tank 92. As illustrated, reflux stream 90 is further augmented with the stream removed from mixing column 52 as a vapor stream 95 which is subsequently condensed within subcooling unit 36 to produce a condensed vapor stream 96. Condensed vapor stream 96 is added to reflux stream 90.

Further thermodynamic efficiency can be realized by removal of an intermediate liquid stream 98 which is subcooled within subcooling heat exchanger 48 and added to low pressure column 32 as a reflux stream. In order to ensure a constant flow rate for reflux stream 98, during the high demand phase, part of the liquid produced travels as a reversible stream 100 to storage tank 102. During the low demand phase, liquid is withdrawn from storage tank 102 and augments reflux stream 98.

While the present invention has been described with reference to a preferred embodiment, as will occur to those skilled in the art, numerous changes, omissions and additions may be made without departing from the spirit and scope of the present invention.

We claim:

1. A method of producing gaseous oxygen at a variable rate having cyclically repeating high and low demand phases, said method comprising the steps of:

(a) rectifying air in a cryogenic rectification process including a double distillation column having lower and higher pressure distillation columns operatively associated with one another in a heat transfer relationship to produce a liquid oxygen column bottoms in said lower pressure column;

(b) introducing a pressurized liquid oxygen stream into a mixing column to produce said gaseous oxygen as tower overhead and an oxygen enriched liquid column bottoms;

(c) introducing a reflux stream into said lower pressure column as reflux;

(d) removing liquid oxygen column bottoms from said lower pressure column;

(e) during said low demand phase using part of the liquid oxygen column bottoms removed from said lower pressure column to form said pressurized liquid oxygen stream and storing a remaining part of said liquid oxygen column bottoms to create stored liquid oxygen column bottoms;

(f) during said high demand phase, using all of the liquid oxygen column bottoms removed from said lower pressure column and said stored liquid oxygen column bottoms to form said pressurized liquid oxygen stream;

(g) removing oxygen enriched liquid column bottoms from said mixing column;

(h) during said high demand phase, using part of the oxygen enriched liquid column bottoms removed from said mixing column to form said reflux stream and storing a remaining part of said oxygen enriched liquid column bottoms to create stored oxygen enriched liquid column bottoms;

(i) during said low demand phase, using all of the oxygen enriched liquid column bottoms removed from said mixing column and stored oxygen enriched liquid column bottoms to form said reflux stream;

(j) steps (d) and (i) being conducted so that flow rates of said liquid oxygen column bottoms removed from said lower pressure column and said reflux stream remain substantially constant during both said low and high demand phases; and extracting a product stream composed of said tower overhead of said mixing column.

2. The method of claim 1, wherein:

said liquid oxygen column bottoms is removed as a liquid stream;

said liquid stream is pumped to produce a pumped liquid stream;

during said low demand phase part of said pumped liquid stream is used to form said pressurized liquid oxygen stream and a remaining part thereof is introduced into a storage tank to create said stored liquid oxygen column bottoms; and during said high demand phase said pressurized liquid oxygen stream is formed by combining said pumped liquid oxygen stream with an auxiliary stream withdrawn from said storage tank.

3. The method of claim 2, wherein:

said air is compressed and purified to form a compressed and purified air stream;

said compressed and purified air stream is divided into first and second subsidiary air streams;

said first subsidiary air stream is cooled to a temperature suitable for its rectification and is divided into first and second portions;

said first portion is introduced into a bottom region of said higher pressure column;

said second subsidiary air stream is compressed within a booster compressor and partly cooled;

during said high demand phase, said second subsidiary air stream is divided into first and second parts, said first part is expanded with the performance of work to form a refrigerant stream, said second part is combined with said second portion of said first subsidiary air stream and then introduced into said mixing column, countercurrently to said pressurized liquid oxygen stream to form said gaseous oxygen; and during said low demand phase, all of said second subsidiary air stream is expanded with the performance of work to form said refrigerant stream and said second portion of said first subsidiary air stream is introduced into said mixing column, countercurrently to said pressurized liquid oxygen stream, thereby to form said gaseous oxygen;

said first part of said second subsidiary air stream and said all of said second subsidiary air stream being expanded at a same flow rate so that flow rate of said refrigerant stream does not vary during said high and low demand phases.

4. The method of claim 3, wherein:

during said high demand phase, an intermediate liquid stream is removed from the mixing column and in part used to form a further reflux stream introduced into said lower pressure column and a remaining part thereof is stored as stored further reflux; and during said low demand phase, said further reflux stream is formed by all of said intermediate liquid stream and said stored further reflux such that a further flow rate of said further reflux stream does not vary between said high and low demand phases, and during said low demand phase, a vapor stream is removed from said mixing column, is condensed, and then added to said reflux stream.

5. The method of claim 1, wherein:

said air is compressed and purified to form a compressed and purified air stream;

said compressed and purified air stream is divided into first and second subsidiary air streams;

said first subsidiary air stream is cooled to a temperature suitable for its rectification and is divided into first and second portions;

said first portion is introduced into a bottom region of said higher pressure column;

said second subsidiary air stream is compressed within a booster compressor and partly cooled;

during said high demand phase, said second subsidiary air stream is divided into first and second parts, said first part is expanded with the performance of work to form a refrigerant stream, said second part is combined with said second portion of said first subsidiary air stream and then introduced into said mixing column, countercurrently to said pressurized liquid oxygen stream to form said gaseous oxygen; and during said low demand phase, all of said second subsidiary air stream is expanded with the performance of work to form said refrigerant stream and said second portion of said first subsidiary air stream is introduced into said mixing column, countercurrently to said pressurized liquid oxygen stream, thereby to form said gaseous oxygen;

said first part of said second subsidiary air stream and said all of said second subsidiary air stream being expanded at a same flow rate so that flow rate of said refrigerant stream does not vary during said high and low demand phases.

6. The method of claim 5, wherein:

during said high demand phase, an intermediate liquid stream is removed from the mixing column and in part used to form a further reflux stream introduced into said lower pressure column and a remaining part thereof is stored as stored further reflux; and during said low demand phase, said further reflux stream is formed by all of said intermediate liquid stream and said stored further reflux such that a further flow rate of said further reflux stream does not vary between said high and low demand phases, and during said low demand phase, a vapor stream is removed from said mixing column, is condensed, and then added to said reflux stream.

* * * * *